US006988935B2

(12) United States Patent
Shiraishi et al.

(10) Patent No.: US 6,988,935 B2
(45) Date of Patent: Jan. 24, 2006

(54) FOREIGN MATTER REMOVING DEVICE AND METHOD

(75) Inventors: Tadashi Shiraishi, Hyogo (JP); Masatoshi Yoshida, Hyogo (JP); Kazunori Kumada, Hyogo (JP); Keita Nakagawa, Hyogo (JP); Makoto Matsubayashi, Hyogo (JP); Mitsuhiro Matsuda, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 198 days.

(21) Appl. No.: 10/470,266

(22) PCT Filed: Aug. 7, 2002

(86) PCT No.: PCT/JP02/08061

§ 371 (c)(1),
(2), (4) Date: Aug. 6, 2003

(87) PCT Pub. No.: WO03/013790

PCT Pub. Date: Feb. 20, 2003

(65) Prior Publication Data

US 2004/0074632 A1 Apr. 22, 2004

(30) Foreign Application Priority Data

Aug. 8, 2001 (JP) ..... 2001-240204

(51) Int. Cl.
*B24B 3/32* (2006.01)

(52) U.S. Cl. ..... 451/38; 451/51; 451/76; 451/102

(58) Field of Classification Search ..... 451/36–40, 451/51, 61, 76, 102
See application file for complete search history.

(56) References Cited

U.S. PATENT DOCUMENTS

| | | | | |
|---|---|---|---|---|
| 2,745,231 | A * | 5/1956 | Prince | 451/36 |
| 5,160,548 | A * | 11/1992 | Boisture | 134/7 |
| 5,664,992 | A * | 9/1997 | Williams, Jr. | 451/76 |
| 6,350,185 | B1 * | 2/2002 | Robins et al. | 451/76 |

FOREIGN PATENT DOCUMENTS

| | | |
|---|---|---|
| JP | 57 - 187596 | 11/1982 |
| JP | 61-263685 | 11/1986 |
| JP | 6- 270065 | 9/1994 |
| JP | 6- 304539 | 11/1994 |
| JP | 7-276232 | 10/1995 |
| JP | 11-58241 | 3/1999 |
| JP | 2001-150348 | 6/2001 |
| KR | 95-20284 | 7/1995 |

* cited by examiner

*Primary Examiner*—George Nguyen
(74) *Attorney, Agent, or Firm*—Oblon, Spivak, McClelland, Maier & Neustadt, P.C.

(57) ABSTRACT

The present invention is one for providing an apparatus and a method which make it possible to remove a foreign object or matter such as scale attached on an inner surface of a pipe easily for a short period of time by means of simple equipment and manner, and constituted as follows. Specifically, a holder (11) is attached onto an end of a pipe (P), an abrasion assisting member (16) fixed to a tip end of a support arm (15) is inserted into the pipe (P) by use of the holder (11) and stopped at an area (A) where oxide scale (S) is generated in a large amount. Then abrasive is sent with pressure into the pipe (P) by a blast device (14), and thus a flow rate of the abrasive in the scale-abraded area (A) is increased to abrade and remove the oxide scale (S) securely. Moreover, if required, a spiral groove (17) is formed on an outer circumference of the abrasion assisting member (16) to increase centrifugal force of the abrasive.

13 Claims, 9 Drawing Sheets

FOREIGN MATTER REMOVING DEVICE AND METHOD

TECHNICAL FIELD

The present invention relates to an apparatus and a method for removing a foreign object or matter such as scale attached onto an inner surface of a small bore pipe such as a heat transfer pipe or a heat exchanger tube of a heat exchanger and an inner surface of a general pipe.

BACKGROUND ART

A heat exchanger is constituted, for example, in the following manner: a large number of heat transfer pipes are arrayed within a housing provided therein so as to be formed in a U shape, and are coupled to a lower inlet collection pipe and a upper outlet collection pipe, respectively. An inlet pipe is provided on an upper portion thereof to communicate or connect with the housing, and an outlet pipe is provided on an upper sidewall thereof to be coupled to an intermediate space thereof.

Hence, for example, if cooling water is supplied from the inlet collection pipe into the large number of heat transfer pipes within the housing while high-temperature air is supplied from the inlet pipe into the housing, then the high-temperature air descends and the cooling water ascends in the housing, and thus a heat exchange is performed. Then, the cooled air reverses itself upward from the lower portion of the housing, ascends through the intermediate space, and is discharged from the outlet pipe. Meanwhile, the cooling water is discharged from the outlet collection pipe.

In such a heat exchanger, it is necessary to perform an ECT inspection for the heat transfer pipes periodically. However, because oxide scale is generated on the inner surfaces of the heat transfer pipes due to long-term use, it is necessary to remove this oxide scale before the inspection. As a method for removing the oxide scale on the inner surfaces of the heat transfer pipes, it is general to use a blast method in which an abrasive is sent with pressure to the heat transfer pipes to abrade and remove the scale. For example, this method is disclosed in Japanese Patent Laid-Open Publication 2001-150348.

As described above, in the conventional oxide scale removing method, the swirling flow of the abrasive is made to collide with the oxide scale generated on the inner surfaces of the steel pipes to perform blast processing therefor, thus removing the oxide scale. The oxide scale can be removed irrespective of the unevenness of the inner surfaces of the steel pipes by allowing the abrasive to collide with the oxide scale as described above on the inner surfaces of the steel pipes from various directions. However, regarding a specific portion where a large amount of oxide scale is generated, the removal of the oxide scale cannot be sufficient. In order to remove the large amount of oxide scale generated on the inner surfaces of the steel pipes, the amount of abrasive and a rate or speed at which the abrasive is sent with pressure must be increased, causing problems that an equipment for abrasion is to be larger and that costs become higher.

Moreover, due to restriction on the local thinning amount of the bent portion of each U-shaped pipe, the increases in the abrasive amount and the pressure rate at which the abrasive is sent with pressure may sometimes be limited when the oxide scale is in a large amount. In this case, the oxide scale is removed by a manual operation, causing a problem that it takes an extremely long time to do the operation for the heat exchanger having no less than several thousands of heat transfer pipes.

The present invention was made in order to solve such problems as described above. It is an object of the present invention to provide an apparatus and a method for removing a foreign object or matter, which are capable of easy removal of the foreign object such as scale attached onto inner surfaces of pipes of nuclear power equipment or the like for a short period of time by means of simple equipment and manner.

DISCLOSURE OF THE INVENTION

An apparatus for removing a foreign object of a first aspect of the present invention, which is for achieving the foregoing object, is characterized by comprising: an abrasion assisting member with a diameter smaller than an inner diameter of a pipe, the abrasion assisting member being inserted into the pipe; a holder mechanism for holding the abrasion assisting member, the holder mechanism being attachable to/detachable from an end of the pipe; and blasting means for sending abrasive with pressure into the pipe to remove the foreign object attached onto an inner surface of the pipe. The abrasive may be sent with pressure from any of the ends of the pipe: the end into which the abrasion assisting member is inserted, and an end opposite thereto.

According to the apparatus for removing a foreign object of the first aspect of the present invention, the foreign object or matter is removed by increasing a flow rate of the abrasive between the inner surface of the pipe and the abrasion assisting member, thus making it possible to abrade and remove the foreign object or matter such as scale attached onto the inner surface of the pipe easily for a short period of time by means of simple equipment.

An apparatus for removing a foreign object of a second aspect of the present invention is characterized in that, in the apparatus for removing a foreign object of the first aspect of the present invention, a holder that is attachable to/detachable from the end of the pipe and a support arm supported in the holder to be freely movable in an axial direction thereof and having a tip end freely insertable into/withdrawable from the pipe through an opening of the pipe are included as the holder mechanism, and the abrasion assisting member is attached onto the tip end of the support arm.

According to the apparatus for removing a foreign object of the second aspect of the present invention, the support arm is operated, thus making it possible to remove the foreign object or matter such as scale attached onto a desired area in the pipe.

An apparatus for removing a foreign object of a third aspect of the present invention is characterized in that, in the apparatus for removing a foreign object of the second aspect of the present invention, a centering mechanism for centering the abrasion assisting member inside the pipe by interposing the support arm therebetween is provided in the holder.

According to the apparatus for removing a foreign object of the third aspect of the present invention, a space between the inner circumference of the pipe and the abrasion assisting member is equalized in a circumferential direction, thus making it possible to remove the foreign object or matter attached onto the inner surface of the pipe appropriately.

An apparatus for removing a foreign object of a fourth aspect of the present invention is characterized in that, in the apparatus for removing a foreign object of the second aspect of the present invention, a clamping member brought into contact with an inner circumferential surface of the pipe for preventing vibrations is provided on the tip end of the abrasion assisting member.

According to the apparatus for removing a foreign object of the fourth aspect of the present invention, the space between the inner surface of the pipe and the abrasion assisting member is maintained at a predetermined interval, thus making it possible to remove the foreign object or matter attached onto the inner surface of the pipe appropriately.

An apparatus for removing a foreign object of a fifth aspect of the present invention is characterized in that, in the apparatus for removing a foreign object of the second aspect of the present invention, a spiral groove is formed on an outer circumferential surface of the abrasion assisting member.

According to the apparatus for removing a foreign object of the fifth aspect of the present invention, a swirling flow of the abrasive is formed between the inner surface of the pipe and the abrasion assisting member, thus making it possible to remove the foreign object or matter attached onto the inner surface of the pipe securely.

An apparatus for removing a foreign object of a sixth aspect of the present invention is characterized in that, in the apparatus for removing a foreign object of the first aspect of the present invention, a tapered portion with an outer diameter thinned downstream of the pipe is provided on the abrasion assisting member.

According to the apparatus for removing a foreign object of the sixth aspect of the present invention, an amount of decompression/expansion by a pressure drop due to a pressure loss is compensated, and a flow rate of the abrasive is made constant, thus making it possible to remove the foreign object attached onto the inner surface of the pipe evenly.

An apparatus for removing a foreign object of a seventh aspect of the present invention is characterized in that, in the apparatus for removing a foreign object of the first aspect of the present invention, a blast path open from the downstream of the abrasive flow, passing through an inside of the abrasion assisting member to an outer circumference thereof is provided in the abrasion assisting member, and second blasting means for sending the abrasive with pressure into the blast path in a reverse direction to a flowing direction of the abrasive in the pipe is included. In this case, the second blasting means may also be commonly used as the blasting means in the apparatus for removing a foreign object of the first aspect of the present invention.

According to the apparatus for removing a foreign object of the seventh aspect of the present invention, an injection of the abrasive from the outer circumference of the abrasion assisting member and a flow of the abrasive in the pipe synergize to increase the total amount of abrasive, and the flow rate of the abrasive on the outer circumference of the abrasion assisting member is further increased by the injection of the abrasive from the outer circumference of the abrasion assisting member, thus making it possible to remove the foreign object or matter attached onto the inner surface of the pipe more effectively.

An apparatus for removing a foreign object of an eighth aspect of the present invention is characterized in that, in the apparatus for removing a foreign object of the seventh aspect of the present invention, the blasting means sends the abrasive with pressure into the pipe from one end of the pipe, and the second blasting means sends the abrasive with pressure into the blast path of the abrasion assisting member from the other end of the pipe.

According to the apparatus for removing a foreign object of the eighth aspect of the present invention, the abrasive can be sent with pressure into the blast path of the abrasion assisting member easily in a reverse direction to the flowing direction of the abrasive in the pipe.

An apparatus for removing a foreign object of a ninth aspect of the present invention is characterized in that, the apparatus for removing a foreign object of the seventh aspect of the present invention comprises: a holder that is attachable to/detachable from the end of the pipe; a support arm supported in the holder to be freely movable in an axial direction thereof and having a tip end freely insertable into/withdrawable from the pipe through an opening of the pipe, as well as the abrasion assisting member attached to the tip end of the arm; and connecting means for connecting the blast path of the abrasion assisting member to the second blasting means, the connecting means being capable of absorbing a distance change between the abrasion assisting member and the second blasting means. As the connecting means, a flexible hose and a telescopic pipe can be used.

According to the apparatus for removing a foreign object of the ninth aspect of the present invention, the support arm is operated, thus making it possible to remove the foreign object or matter attached onto the desired area in the pipe.

An apparatus for removing a foreign object of a tenth aspect of the present invention is characterized in that, in the apparatus for removing a foreign object of the first aspect of the present invention, a spiral groove is provided on the abrasion assisting member.

According to the apparatus for removing a foreign object of the tenth aspect of the present invention, a swirling flow of the abrasive is generated between the inner surface of the pipe and the outer surface of the abrasion assisting member, thus increasing centrifugal force of the abrasive to enhance the abrasion effect, and making it possible to abrade the abrade surface, that is, the inner surface of the pipe smoothly.

A method for removing a foreign object of an eleventh aspect of the present invention, which is for achieving the foregoing object, is characterized by comprising the steps of: inserting, into a pipe, an abrasion assisting member with a diameter smaller than an inner diameter of the pipe; sending abrasive with pressure into the pipe; increasing a flow rate of the abrasive in a space between an inner surface of the pipe and the abrasion assisting member; and removing a foreign object attached onto the inner surface of the pipe.

According to the method for removing a foreign object of the eleventh aspect of the present invention, the foreign object or matter such as scale attached onto the inner surface of the pipe can be removed easily for a short period of time in a simple manner.

A method for removing a foreign object of a twelfth aspect of the present invention is characterized in that, in the method for removing a foreign object of the eleventh aspect of the present invention, the abrasion assisting member is inserted into the pipe by interposing a support arm therebetween, and the abrasion assisting member is centered and held at a position facing to the foreign object.

According to the method for removing a foreign object of the twelfth aspect of the present invention, a space between the inner surface of the pipe and the abrasion assisting member is equalized in the circumferential direction, thus making it possible to remove the foreign object or matter attached onto the inner surface of the pipe appropriately.

A method for removing a foreign object of a thirteenth aspect of the present invention is characterized in that, in the method for removing a foreign object of the eleventh aspect of the present invention, the abrasive is sent with pressure into an inside of the abrasion assisting member in a reverse direction to a flowing direction of the abrasive in the pipe, and the abrasive is injected from an inside of the abrasion assisting member to an outer circumference thereof.

According to the method for removing a foreign object of the thirteenth aspect of the present invention, an injection of the abrasive from the outer circumference of the abrasion assisting member and a flow of the abrasive in the pipe synergize to increase the total amount of abrasive, and the flow rate of the abrasive on the outer circumference of the abrasion assisting member is further increased by the injection of the abrasive from the outer circumference of the abrasion assisting member, thus making it possible to remove the foreign object or matter attached onto the inner surface of the pipe more effectively.

A method for removing a foreign object of a fourteenth aspect of the present invention is characterized in that, in the method for removing a foreign object of the eleventh aspect of the present invention, the flow rate of the abrasive is made constant by a tapered portion with an outer diameter thinned downstream of the pipe, the tapered portion being formed on the abrasion assisting member.

According to the method for removing a foreign object of the fourteenth aspect of the present invention, the foreign object or matter attached onto the inner surface of the pipe can be removed evenly.

A method for removing a foreign object of a fifteenth aspect of the present invention is characterized in that, in the method for removing a foreign object of the eleventh aspect of the present invention, centrifugal force of the abrasive is increased by a spiral groove formed on the abrasion assisting member.

According to the method for removing a foreign object of the fifteenth aspect of the present invention, a swirling flow of the abrasive is generated between the inner surface of the pipe and the outer surface of the abrasion assisting member, thus increasing centrifugal force of the abrasive to enhance the abrasion effect, and making it possible to abrade the abraded surface, that is, the inner surface of the pipe smoothly.

BEST MODE FOR CARRYING OUT THE INVENTION

Figure 1:
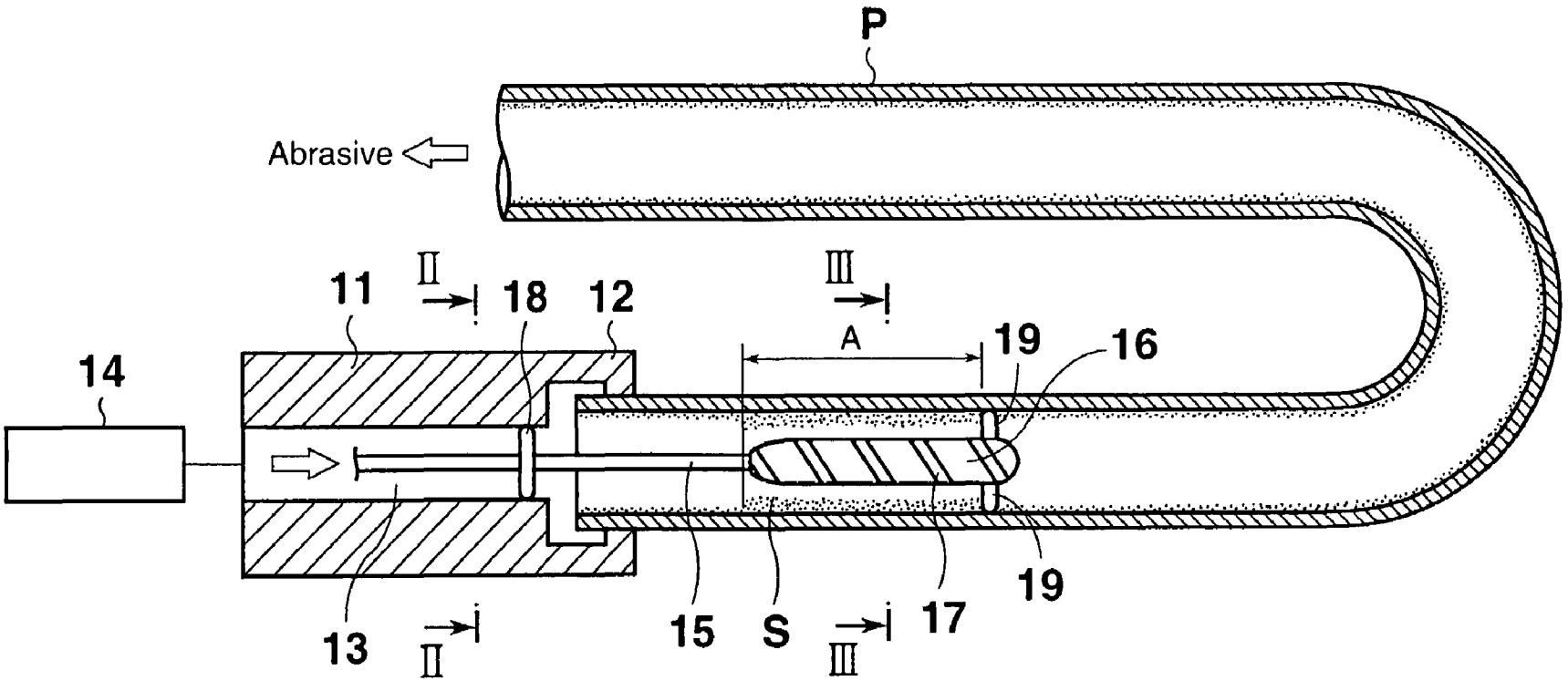
FIG. 1 is a schematic cross-sectional view of a foreign object removing apparatus according to a first embodiment of the present invention.

Embodiments of the present invention will be described below in detail based on the drawings. In the drawings, a reference symbol P denotes a pipe; a reference symbol S denotes oxide scale (foreign object or matter); a reference symbol A denotes a scale-abraded area; reference numerals 11 and 11*a* denote holders; reference numerals 12 and 12*a* denote engaging portions; reference numerals 13 and 13*a* denote blast paths of the holders; reference numerals 14 and 14*a* denote blast devices (blasting means); a reference numeral 15 denotes a support arm; a reference numeral 16 denotes an abrasion assisting member; a reference numeral 17 denotes a spiral groove; a reference numeral 18 denotes guide protrusions (centering mechanism); a reference numeral 19 denotes support protrusions (clamping member); a reference numeral 20 denotes a tapered portion of the abrasion assisting member (downstream side); a reference numeral 21 denotes a tapered portion of the abrasion assisting member (upstream side); a reference numeral 22 denotes a blast path of the abrasion assisting member; a reference numeral 23 denotes outer circumferential openings of the abrasion assisting member; a reference numeral 24 denotes a blast path (connecting means) of the support arm; a reference numeral 27 denotes a valve; and a reference numeral 28 denotes a flexible hose (connecting means).

First Embodiment

Figure 2:
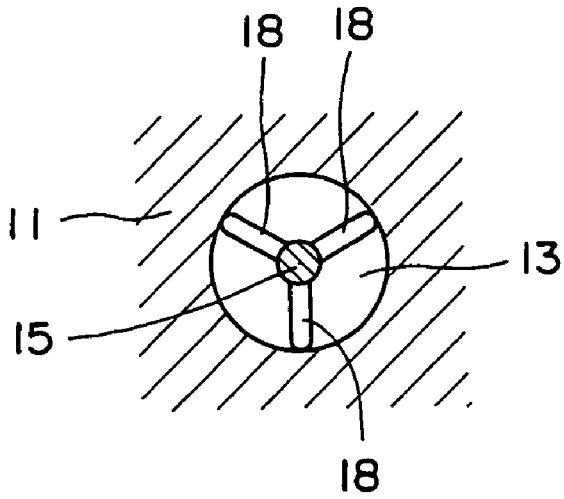
FIG. 2 is a cross-sectional view taken along the plane II—II of FIG. 1.
Figure 3:
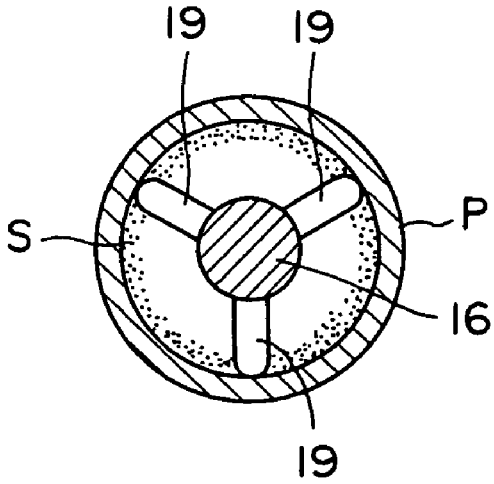
FIG. 3 is a cross-sectional view taken along the plane III—III of FIG. 1.

FIG. 1 is a view schematically illustrating a foreign object removing apparatus according to a first embodiment of the present invention, FIG. 2 shows a cross-section taken along the plane II—II of FIG. 1, and FIG. 3 shows a cross-section taken along the plane III—III of FIG. 1.

As illustrated in FIGS. 1 to 3, the foreign object removing apparatus of this first embodiment is one for use, for example, in the case of abrading the scale S as a foreign object generated in the pipe P used as a heat transfer pipe or the like of a heat exchanger for atomic equipment. Particularly, a large amount of the scale S is generated in the area A in the vicinity of the opening of the pipe P.

For example, when a pipe plate is made of SUS304 and a heat transfer pipe is made of a copper-nickel alloy, for example, a large amount of layer having a thickness of 70 to 100 $\mu$m, from which nickel is desorbed, is generated in an area where the pipe plate and the outlet portion of the heat transfer pipe are connected to each other. This layer becomes a cause of noise in an ECT inspection, and may sometimes inhibit detection of corrosion between the pipe plate and the heat transfer pipe. Incidentally, in the portion other than the above-described area, the thickness of the layer is 2 to 3 $\mu$m. As such, the amount of scale is varied to a large extent.

In this foreign object removing apparatus, as a holder mechanism for holding the abrasion assisting member 16, the holder 11, the support arm 15 and the centering mechanism 18 are provided. The holder 11 has the engaging portion 12 freely attachable to/detachable from the opening end of the pipe P. In the inside of the holder 11, the blast path 13 forming a circular cross-section is formed. The blast path 13 is different from the blast path 22 inside the abrasion assisting member 16 to be described later with reference to FIG. 6. Then, to the blast path 13 of this holder 11, the blast device 14 is connected, which abrades and removes the scale S attached onto the inner surface of the pipe P by sending an abrasive (for example, fine particles of alumina) into the pipe P by means of compressed air.

The support arm 15 is supported in the blast path 13 of the holder 11 to be freely movable in an axial direction thereof. The support arm 15 has an unillustrated operation unit operatable by an operator on a base end thereof, and a tip end thereof is freely insertable into/withdrawable from the inside of the pipe P through the opening end of the pipe P. The abrasion assisting member 16 is fixed to this tip end.

This abrasion assisting member 16 is formed in a cylindrical shape with a diameter smaller than the inner diameter of the pipe P, and on an outer circumferential surface thereof, the spiral groove 17 is formed. The spiral groove 17 generates a swirling flow of the abrasive between the inner surface of the pipe P and the outer surface of the abrasion assisting member 16.

Moreover, the three guide protrusions 18 as a centering mechanism for centering the abrasion assisting member 16 in the pipe P are fitted onto the intermediate portion of the support arm 15. Each of these guide protrusions 18 has an equal length to one another, and is fitted onto the support arm 15 in a circumferential direction at an approximately equal interval. The tip end of each guide protrusion 18 is engaged with the inner wall surface of the blast path 13 to be freely slidable. Hence, the holder 11 is engaged with the pipe P by the engaging portion 12 so that the axial centers of the blast path 13 and the pipe P can coincide with each other, and the support arm 15 is centered by the guide protrusions 18 in the blast path 13, thus making it possible to center the abrasion resistant member 16 in the pipe P.

Furthermore, onto the tip end of the abrasion assisting member 16, the three support protrusions 19 are fitted as clamping members for holding the abrasion assisting member 16 so that the member 16 does not vibrate in the pipe P. Each of these support protrusions 19 has an equal length to one another, and is fitted onto the abrasion assisting member 16 in a circumferential direction at an approximately equal interval. The tip end of each support protrusion 19 is freely slidable on the inner circumferential surface of the pipe P. Hence, the abrasion assisting member 16 centered in the pipe P by the guide protrusions 18 with the support arm 15 interposed therebetween is appropriately supported by the support protrusions 19 without any vibrations. The abrasion assisting member 16 is also centered by the support protrusions 19.

Here, descriptions will be made for work of removing the oxide scale S generated on the inner surface of the pipe P by means of the foreign object removing apparatus of the first embodiment, which is constituted as described above. In this case, it is inspected beforehand in which position of the pipe P the oxide scale S is generated in a large amount so that a scale-abraded area is preset. In this first embodiment, this area is set in the area A in the vicinity of the opening of the pipe P.

First, the engaging portion 12 is engaged with the opening end of the pipe P, and thus the holder 11 is attached onto the pipe P. Then, the blast device 14 is connected to the blast path 13 of the holder 11. Next, the abrasion assisting member 16 is inserted into the pipe P by the support arm 15 and is stopped at the scale-abraded area A where the oxide scale S is generated in a large amount. At this point, the abrasion assisting member 16 is centered by the guide protrusions 18 with the support arm 15 interposed therebetween. Thus, a distance between the inner surface of the pipe P and the outer surface of the abrasion assisting member 16 becomes substantially equal in the circumferential direction.

In this state, an abrasive is sent into the pipe P through the blast path 13 by compressed air by means of the blast device 14. Then, because the abrasion assisting member 16 is located in the scale-abraded area A in the pipe P, a flow passage for the abrasive in this scale-abraded area A is narrowed as compared with those in areas therebefore and thereafter, and the flow speed or rate of the abrasive is increased. Therefore, more abrasive will collide with the oxide scale S generated on the inner surface of the pipe P at a higher rate, and an abrasion effect is enhanced in proportion to the square of the flow rate, thus making it possible to abrade and remove the large amount of oxide scale S easily and securely.

Moreover, the spiral groove 17 is formed on the outer circumferential surface of the abrasion assisting member 16, and therefore, the swirling flow of the abrasive will be generated and held between the inner surface of the pipe P and the outer surface of the abrasion assisting member 16. Accordingly, the centrifugal force of the abrasive is increased to enhance the abrasion effect, and the abraded surface, that is, the inner surface of the pipe P can be abraded smoothly. Furthermore, the tip end (downstream portion) of the abrasion assisting member 16 is supported to be clamped by the support protrusions 19, and the abrasion assisting member 16 does not vibrate due to the swirling flow and the like, thus making it possible to perform appropriate abrading work. Moreover, the front and rear ends of the abrasion assisting member 16 are spherical, and the swirling flow will be straightened downstream of this abrasion assisting member 16 to be flown smoothly without generating turbulence.

As described above, in the foreign object removing apparatus of this first embodiment, the holder 11 is attached onto the end of the pipe P, and the abrasion assisting member 16 fixed to the tip end of the support arm 15 is inserted into the pipe P by use of the holder 11 and stopped at the scale-abraded area A where the oxide scale S is generated in a large amount, thus being adapted to send the abrasive with pressure into the pipe P by means of the blast device 14.

Hence, the flow passage of the abrasive is narrowed to increase the flow rate in the scale-abraded area A where the abrasion assisting member 16 is located, and therefore, much abrasive will collide with the oxide scale S generated on the inner surface of the pipe P at a higher rate, thus making it possible to abrade and remove this oxide scale S easily and securely for a short period of time.

In the above-described embodiment, the pipe is formed into a hollow cylinder shape, and the abrasion assisting member 16 is formed into a solid cylinder shape. However, the abrasion assisting member 16 may be formed in a solid prism shape if the pipe is formed in a hollow prism shape. Moreover, the numbers and shapes of the guide protrusions 18 as the centering mechanism and of the support protrusions 19 as the clamping members are not limited to those of this embodiment.

Moreover, in the above-described first embodiment, the abrasion assisting member 16 is set to have a constant diameter except the spherical front and rear ends thereof. However, as the tapered portion 20 illustrated in FIG. 4, almost all portions of the abrasion assisting member 16 may be formed in a tapered shape in which an outer diameter is thinned or decreased downstream of the pipe. This tapered portion 20 compensates an amount of decompression/expansion by a pressure drop due to a pressure loss, and makes the flow rate of the abrasive more constant than in the case where the tapered portion 20 is not provided. Therefore, the scale-abraded area A can be abraded evenly. The extent of the tapered, shape can be set appropriately by, for example, experiments and the like. Reversely to this, the portion 21 that is upstream of the downstream tapered portion 20 is formed in a tapered shape in which an outer diameter is thinned toward the upstream so as to reduce resistance. Moreover, the downstream tapered portion 20 and the upstream tapered portion 21 will straighten the swirling flow downstream of the abrasion assisting member 16, and the swirling flow is flown smoothly without generating turbulence or the like.

Moreover, although the support arm 15 is supported to be freely movable in the axial direction in the blast path 13 of the holder 11, it is not necessary that the support arm 15 be freely movable when the scale-abraded area A is fixedly determined, then a support arm 15 in which a length is preset in accordance with the scale-abraded area A can be used when the scale-abraded area A is fixedly determined.

Second Embodiment

Figure 5:
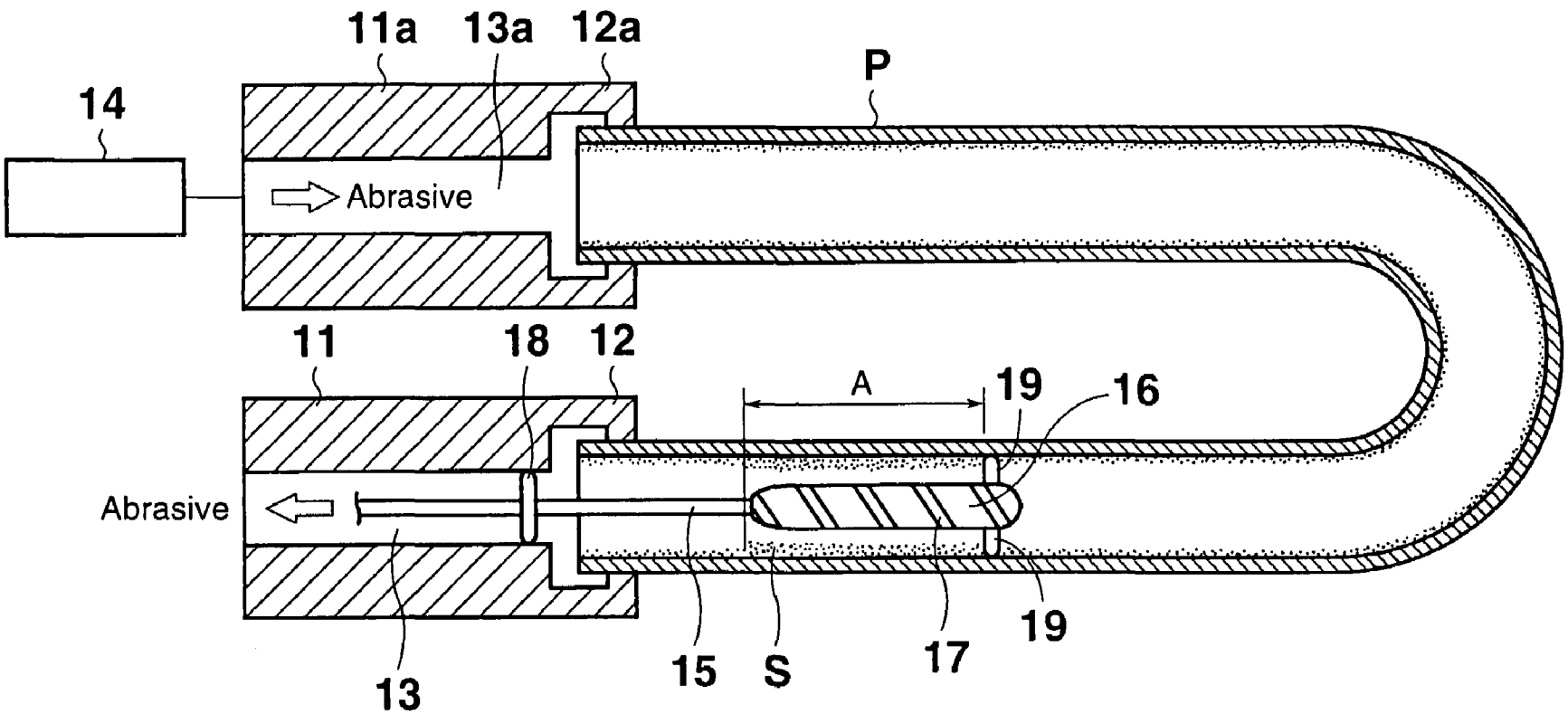
FIG. 5 is a schematic cross-sectional view of a foreign object removing apparatus according to a second embodiment of the present invention.

Next, FIG. 5 schematically illustrates a foreign object removing apparatus according to a second embodiment of the present invention. In the above-described first embodiment, the abrasion assisting member. 16 is inserted and the abrasive is sent with pressure from the same end. However, in this second embodiment, as illustrated in FIG. 5, the insertion and the sending are performed from ends opposite to each other.

Similarly to the apparatus illustrated in FIG. 1, the foreign object removing apparatus of this second embodiment is one used in the case of abrading the scale S as a foreign object generated in the pipe P used as the heat transfer pipe or the like of the heat exchanger.

Specifically, as illustrated in FIG. 5, in the foreign object removing apparatus of this second embodiment, the holder 11, which has the blast path 13 with a circular cross-section in the inside thereof and the engaging portion 12, is attached to be freely attachable to/detachable from one opening end of the pipe P, similarly to FIG. 1. Moreover, another holder 11*a* is attached freely detachably onto another opening end of the pipe P. This holder 11*a* also has the engaging portion 12*a* freely attachable to/detachable from the opening end of the pipe P, and in the inside thereof, a blast path 13*a* forming a circular cross-section is formed. Then, to the blast path 13*a* of this holder 11*a*, the blast device 14 is connected, which abrades and removes the scale S attached onto the inner surface of the pipe P by sending the abrasive with pressure into the pipe P by means of compressed air.

Moreover, in the holder 11, similarly to FIG. 1, the support arm 15 is supported in the blast path 13 so as to be freely movable in the axial direction. This support arm 15 has an unillustrated operation unit by an operator on a base end thereof, and a tip end that is freely insertable to/withdrawable from inside of the pipe P through the opening end of the pipe P. The abrasion assisting member 16 is fixed to this tip end.

In this second embodiment, the abrasion assisting member 16 has a smaller diameter than the inner diameter of the pipe P, and on the outer circumferential surface thereof, the spiral groove 17 is formed. With regard to the shape of the abrasion assisting member 16, similarly to the one illustrated in FIG. 4, almost all portions are formed in a tapered shape, in which an outer diameter is thinned downstream of the pipe, so that the flow rate of the abrasive can be made constant and the scale-abraded area A can be abraded evenly. Reversely to this, the portion 21 in the upstream of this tapered portion 20 is formed in a tapered shape in which an outer diameter is thinned toward the upstream so as to reduce resistance. Similarly to the one in FIG. 1, the spiral groove 17 is formed also on the outer circumference of this abrasion assisting member 16, if required.

Moreover, similarly to FIG. 1, the three guide protrusions 18 as a centering mechanism are fitted onto the intermediate portion of the support arm 15, and the three support protrusions 19 as clamping members are fitted onto the tip end of the abrasion assisting member 16.

Figure 4:
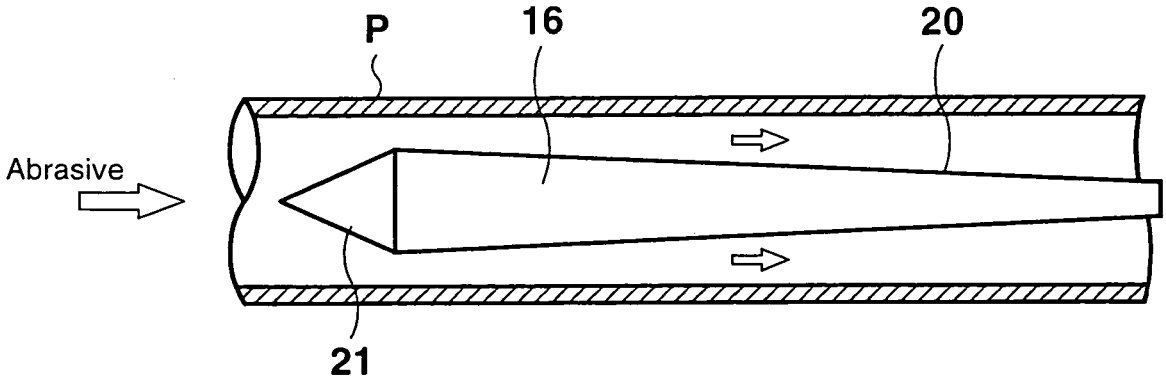
FIG. 4 is a view illustrating an abrasion assisting member having a tapered portion.

In the case of removing the foreign object by use of the foreign object removing apparatus of this second embodiment, first, the engaging portion 12 is engaged with the one opening end of the pipe P to be attached onto the holder 11, the abrasion assisting member 16 is inserted into the pipe P by the support arm 15 and stopped at the scale-abraded area A where the oxide scale S is generated in a large amount. Moreover, the engaging portion 12*a* is engaged with the other opening end of the pipe P to be attached onto the holder 11*a*, and the blast device 14 is connected to the blast path 13*a* of the holder 11*a*. In this state, the abrasive is sent with pressure through the blast path 13*a* into the pipe P by the blast device 14 by means of compressed air. Consequently, an operational advantage similar to that described with reference to FIGS. 1 and 4 is obtained.

Third Embodiment

Figure 6:
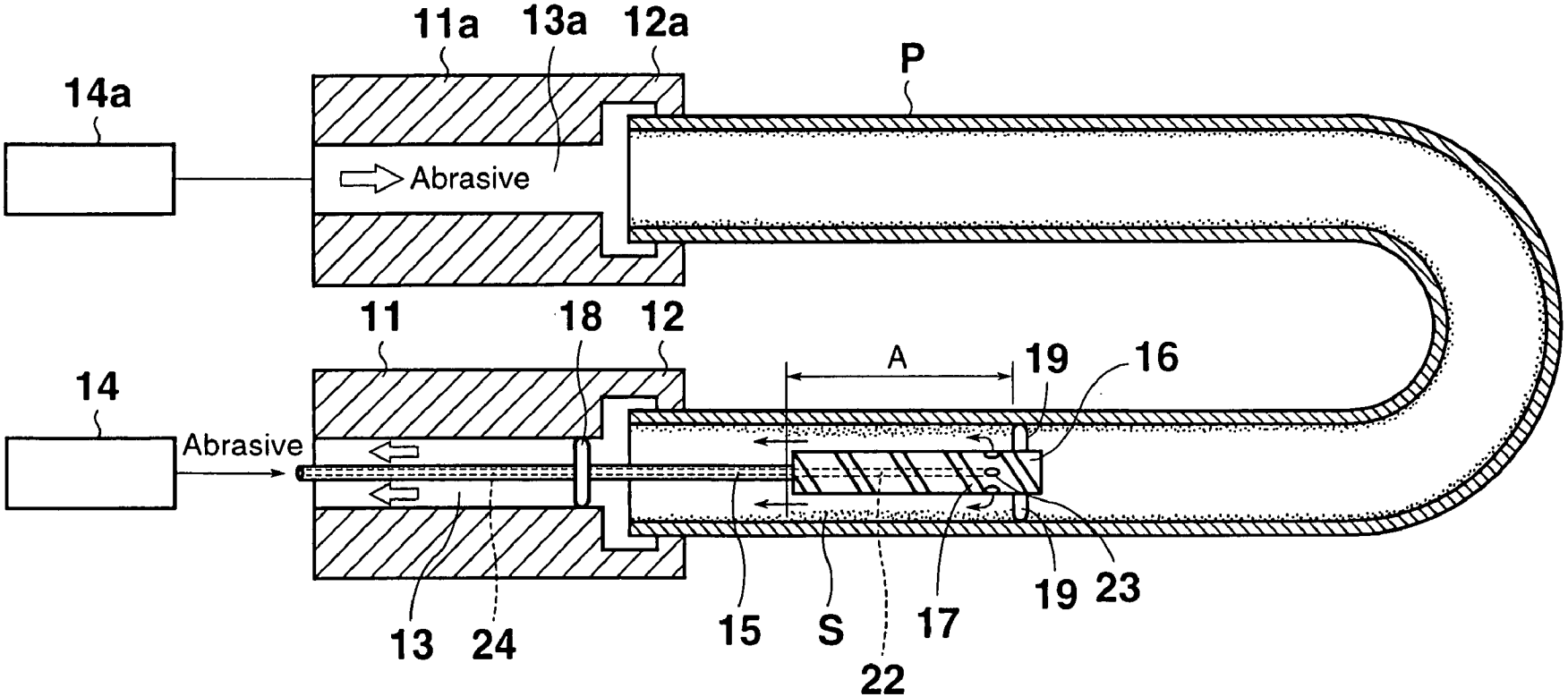
FIG. 6 is a schematic cross-sectional view of a foreign object removing apparatus according to a third embodiment of the present invention.

Next, FIG. 6 schematically illustrates a foreign object removing apparatus according to a third embodiment of the present invention. The foreign object removing apparatus of this third embodiment is also one used in the case of abrading the scale S as a foreign object generated in the pipe P used as a heat transfer pipe or the like of the heat exchanger, similarly to the one illustrated in FIG. 1.

In this third embodiment, as illustrated in FIG. 6, the abrasive is sent with pressure from a blast device 14*a* into the pipe P. In addition to this, the abrasive is also sent with pressure from another blast device 14 into the inside of the abrasion assisting member 16 in a reverse direction to the flowing direction of the abrasive in the pipe P. Thus, the abrasive is injected from the inside toward the circumference of the abrasion assisting member 16.

In this foreign object removing apparatus, as a holder mechanism for holding the abrasion assisting member 16, the holder 11, the support arm 15 and the centering mechanism 18 are provided similarly to that of FIG. 1. The holder 11 has the engaging portion 12 freely attachable to/detachable from one opening end of the pipe P, and in the inside thereof, the blast path 13 forming a circular cross-section is formed. However, the blast device 14 is connected so as to send the abrasive with pressure not into the blast path 13 of the holder 11 but into the blast path 22 inside the abrasion assisting member 16, though described later in detail. Then, in order to send the abrasive with pressure into the pipe P, another holder 11*a* and another blast device 14*a* are provided. The holder 11*a* has the engaging portion 12*a* freely attachable to/detachable from the other opening end of the pipe P, and in the inside thereof, the blast path 13*a* forming a circular cross-section is formed. Another blast device 14*a* is connected to this blast path 13*a* of the holder 11*a*. Any of the blast devices 14 and 14*a* is one for abrading and removing the scale S attached onto the inner surface of the pipe P by sending the abrasive such as fine particles of alumina with pressure by means of compressed air.

Similarly to that of FIG. 1, the support arm 15 is supported in the blast path 13 of the holder 11 to be freely movable in the axial direction. The support arm 15 has an unillustrated operation unit operatable by an operator on the base end, and the tip end is freely insertable into/withdrawable from the inside of the pipe P through the opening end of the pipe P. The abrasion assisting member 16 is fixed to this tip end.

The abrasion assisting member 16 is formed in a cylindrical shape with a diameter smaller than the inner diameter of the pipe P, and on the outer circumferential surface, the spiral groove 17 is formed.

Moreover, in this abrasion assisting member 16, there is provided the blast path 22 that is open from the downstream of the abrasive flow, passing through the inside of the abrasion assisting member 16 to the outer circumference thereof with respect to the flowing direction of the abrasive in the pipe P that is sent with pressure from the blast device 14*a*. The openings 23 on the circumference are located as upstream as possible and provided in plural at an approximately equal interval in the circumferential direction.

Furthermore, the three guide protrusions 18 as a centering mechanism for centering the abrasion assisting member 16 in the pipe P are fitted onto the intermediate portion of the support arm 15 similarly to those of FIG. 1. Each of these guide protrusions 18 has an equal length to one another, and is fitted onto the support arm 15 in the circumferential direction at an approximately equal interval. The tip end of each guide protrusion 18 is engaged with the inner wall surface of the blast path 13 to be freely slidable. Hence, the holder 11 is engaged with the pipe P so that the axial centers of the blast path 13 and the pipe P can coincide with each other, and the support arm 15 is centered by the guide protrusions 18 in the blast path 13, thus making it possible to center the abrasion resistant member 16 in the pipe P.

Moreover, in the inside of the support aim 15, the blast path 24 communicating or connecting with the blast path 22 of the abrasion assisting member 16 is made open, and the blast device 14 is connected to the blast path 24 of this support arm 15.

Moreover, onto the tip end of the abrasion assisting member 16 (upstream end with respect to the flowing direction of the abrasive in the pipe P), the three support protrusions 19 are fitted as clamping members for holding this abrasion assisting member 16 so that this member 16 does not vibrate in the pipe P. Each of these support protrusions 19 has an equal length to one another, and is fitted onto the abrasion assisting member 16 in the circumferential direction at an approximately equal interval. The tip end of each support protrusion 19 is freely slidable on the inner circumferential surface of the pipe P. Hence, the abrasion assisting member 16 centered in the pipe P by the guide protrusions 18 with the support arm 15 interposed therebetween is appropriately supported by the support protrusions 19 without any vibrations. The abrasion assisting member 16 is also centered by the support protrusions 19.

Here, descriptions will be made for work of removing the oxide scale S generated on the inner surface of the pipe P by means of the foreign object removing apparatus of this embodiment, which is constituted as described above. In this case, it is inspected beforehand in which position of the pipe P the oxide scale S is generated in a large amount so that a scale-abraded area is preset. In this embodiment, this area is set in the area A in the vicinity of the outlet opening of the pipe P.

First, the engaging portion 12 is engaged with the one opening end of the pipe P, and thus the holder 11 is attached onto the pipe P. Then, the blast device 14 is connected to the blast path 22 of the abrasion assisting member 16 by interposing the blast path 24 of the support arm 15 therebetween. Moreover, the engaging portion 12*a* is engaged with the other opening end of the pipe P, and thus the holder 11*a* is attached onto the pipe P. Then, the blast device 14*a* is connected to the blast path 13*a* of the holder 11*a*. Next, the abrasion assisting member 16 is inserted into the pipe P by the support arm 15 and is stopped at the scale-abraded area A where the oxide scale S is generated in a large amount. At this point, the abrasion assisting member 16 is centered by the guide protrusions 18 with the support arm 15 interposed therebetween. Thus, a distance between the inner surface of the pipe P and the outer surface of the abrasion assisting member 16 becomes substantially equal in the circumferential direction.

In this state, the abrasive is sent with pressure into the blast path 22 of the abrasion assisting member 16 by compressed air by means of the blast device 14 and directly injected from the outer circumferential openings 23 to the pipe P. Moreover, the abrasive is sent with pressure through the blast path 13*a* into the pipe P by compressed air by means of the blast device 14*a*.

Then, because the abrasion assisting member 16 is located in the scale-abraded area A in the pipe P, the flow passage for the abrasive in this scale-abraded area A is narrowed as compared with those in areas therebefore and thereafter, and the flow rate or speed of the abrasive sent with pressure from the blast device 14*a* is increased. In addition to this, the abrasive sent with pressure from the blast device 14 is directly injected from the outer circumferential openings 23 of the abrasion assisting member 16, joined to the abrasive from the blast device 14*a*, and flown to the one end of the pipe P. Therefore, as a synergistic effect of these, the total amount of abrasive is increased. In addition, the flow rate or speed of the abrasive on the outer circumference of the abrasion assisting member 16 is further enhanced due to the injection of the abrasion from the outer circumferential openings 23 of the abrasion assisting member 16. Therefore, more abrasive will collide with the oxide scale S generated on the inner surface of the pipe P at a higher rate, and an abrasion effect (abrasion force) is enhanced, thus making it possible to abrade and remove the large amount of oxide scale S easily and securely.

In this case, the blast device 14*a* sends the abrasive with pressure from the other opening end of the pipe P into the pipe P, and the blast device 14 sends the abrasive with pressure from the one end of the pipe P into the blast path 22 of the abrasion assisting member 16. Therefore, the abrasion sending direction in the blast path 22 of the abrasion assisting member 16 can be easily reversed from the flowing direction of the abrasive in the pipe P. Moreover, because the blast device 14 and the blast device 14*a* exist, the amount of abrasive and the flow rate at which the abrasive is sent with pressure by the blast device 14 and the amount of abrasive and the flow rate at which the abrasive is sent with pressure by the blast device 14*a* can be adjusted in accordance with a situation where the scale is attached onto the pipe P. For example, in the case of abrading the vicinity of the outlet opening of the U shaped tube or pipe of the heat exchanger, the increases in the abrasive amount from the blast device 14*a* and the flow rate at which the abrasive is sent with pressure therefrom are restricted to the limitations due to the restriction on the local thinning amount of the bent portion of the U shape pipe. Instead, the amount of abrasive from the blast device 14 and the flow rate at which the abrasive is sent with pressure therefrom are greatly increased, thus securing the amount of abrasion and the flow rate of abrasive, which are required in the scale-abraded area A, as a whole. Thus, the large amount of scale S can be abraded in the scale-abraded area A while inhibiting abnormal thinning.

Operational advantages (generation of the swirling flow of the abrasive, an increase in the centrifugal force of the abrasive, improvement of the abrasion effect, and smooth abrasion) due to the spiral groove 17 formed on the outer circumferential surface of the abrasion assisting member 16, operational advantages (vibration prevention of the abrasion assisting member 16 due to the swirling flow and the like, and appropriate abrasion) due to the support protrusions 19 on the tip end of the abrasion assisting member 16, and so on are similar to those described with reference to FIG. 1.

Moreover, in the place where the amount of the scale attached is locally large, such as the scale-abraded area A, the bore of the blast path 22 of the abrasion assisting member 16, the bore and number of the outer circumferential openings 23 thereof and the bore of the blast path 24 of the support arm 15 are changed in accordance with the amount of scale attached, thus making it possible to control the flow rate on the outer circumference of the abrasion assisting member 16, leading to the improvement of the scale abrasion.

As described above, in the foreign object removing apparatus of this third embodiment, the holder 11*a* is attached onto the other end of the pipe P, and the abrasive is sent with pressure from the blast path 13*a* of this holder 11*a* into the pipe P by use of blast device 14*a*. In addition to this, the holder 11 is attached onto the one end of the pipe P, and the abrasion assisting member 16 fixed to the tip end of the support arm 15 is inserted into the pipe P by use of this holder 11 and stopped at the area A where the oxide scale S is generated in a large amount. Then, the abrasive is sent with pressure into the blast path 22 in the inside of the abrasion assisting member 16 by the blast device 14 in the reverse direction to the flowing direction of the abrasive from the blast device 14*a*. Thus, the abrasive is injected from the inside to the outer circumference of the abrasion assisting member 16.

Hence, in the scale-abraded area A where the abrasion assisting member 16 is located, the flow of the abrasive from the blast device 14*a* and the direct injection of the abrasive from the outer circumference of the abrasion assisting member 16 synergize to increase the total amount of abrasive. In addition, due to the injection of the abrasive from the outer circumference of the abrasion assisting member 16, the flow rate of the abrasive on the outer circumference of the abrasion assisting member 16 is further increased. Therefore, more abrasive will collide with the oxide scale S generated on the inner surface of the pipe P at a higher rate, thus making it possible to abrade and remove this oxide scale S easily and securely for a short period of time.

In the above-described third embodiment, both ends (front end and rear end) of the abrasion assisting member 16 may be formed to be spherical similarly to those illustrated in FIG. 1. Moreover, the pipe P is formed into the hollow cylindrical shape, and the abrasion assisting member 16 is formed into the solid cylindrical shape. However, if the pipe is formed into the hollow prism shape, then the abrasion assisting member 16 may be formed into the solid prism shape. Moreover, the numbers and shapes of the guide protrusions 18 as a centering mechanism and of the support protrusions 19 as clamping members are not limited to those of this embodiment.

Figure 7:
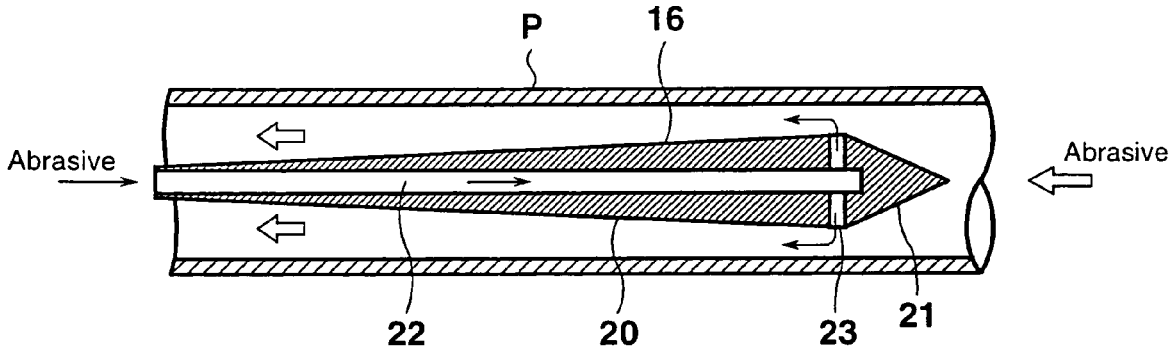
FIG. 7 is a view illustrating an abrasion assisting member having a tapered portion.

Moreover, although the shape of the abrasion assisting member 16 is made in a constant outer diameter in the above-described third embodiment, almost all portions thereof may be formed in a tapered shape in which an outer diameter is thinned downstream of the pipe as illustrated in FIG. 7. This tapered portion 20 shown in FIG.7 compensates an amount of decompression/expansion by a pressure drop, and makes the flow rate of the abrasive more constant than in the case where the tapered portion 20 is not provided. Therefore, the scale-abraded area A can be abraded evenly. The extent of the tapered shape can be set appropriately by, for example, experiments and the like. Reversely to this, the portion 21 in the upstream of this downstream tapered portion 20 is formed in a tapered shape in which an outer diameter is thinned toward the upstream so as to reduce resistance. The spiral groove 17 is formed also on the outer circumference of this abrasion assisting member 16 as required, similarly to the one in FIG. 1. In FIG. 7, a reference numeral 22 denotes the blast path, and a reference numeral 23 denotes the outer circumferential openings. The outer circumferential openings 23 may exist in the downstream tapered portion 20.

Figure 8:
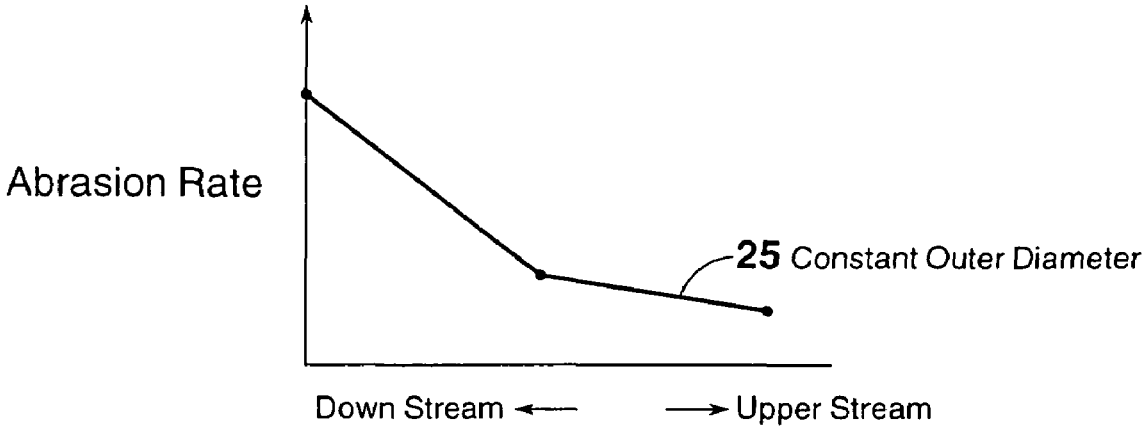
FIG. 8 is a graph showing a relationship between an abrasion rate or speed in an abrasion assisting member with a constant outer diameter and a position thereof in an area where scale is abraded.
Figure 9:
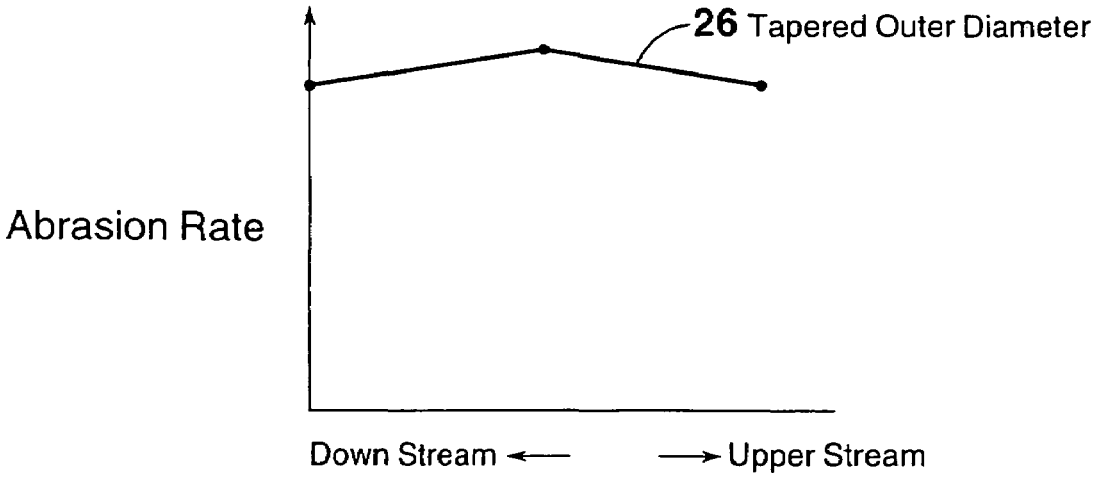
FIG. 9 is a graph showing a relationship between an abrasion rate or speed in an abrasion assisting member having a tapered portion and a position thereof in an area where scale is abraded.

FIG. 8 exemplifies the relationship 25 between the abrasion rate or cutting rate or grinding rate in use of the abrasion assisting member with a constant outer diameter (FIG. 6) and the position thereof in the scale-abraded area A. FIG. 9 exemplifies the relationship 26 between the abrasion rate or cutting rate or grinding rate in use of the abrasion assisting member having the tapered portion 20 (FIG. 7) and the position thereof in the scale-abraded area A. Because the flow rate is equalized in the case where the tapered portion 20 is provided, it is understood from FIGS. 8 and 9 that the abrasion rate is equalized more in the case where the tapered portion 20 is provided (FIG. 7) than in the case where the outer diameter is constant (FIG. 6), thus enabling even abrasion.

Figure 10:
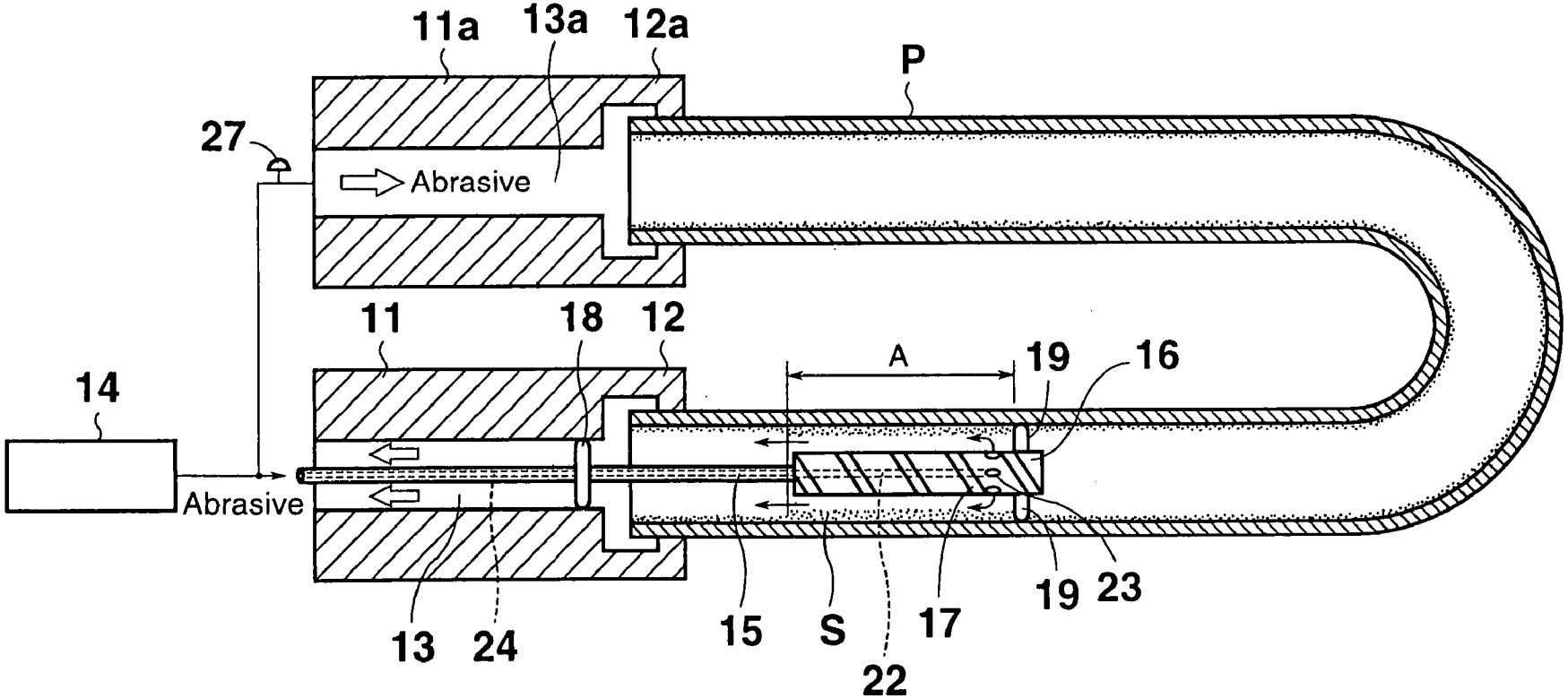
FIG. 10 is a schematic cross-sectional view of a foreign object removing apparatus constituted to commonly use one blast device for sending an abrasive with pressure to a pipe and sending an abrasive with pressure to a blast path of the abrasion assisting member.

Moreover, although the two blast devices 14 and 14*a* are used in the above-described third embodiment, an output from one blast device 14 may be branched into two to be substituted for the two blast devices 14 and 14*a* as illustrated in FIG. 10. In this case, the blast device 14 and a path that is branched from the output thereof and reaches one opening end of the pipe P will constitute one blasting means, and the blast device 14 and another path that is branched from the output thereof and reaches another opening end of the pipe P will constitute another blasting means. The amount of abrasive and the flow rate at which the abrasive is sent with pressure can be adjusted by providing the appropriate valve 27 on the guiding branch.

Figure 11:
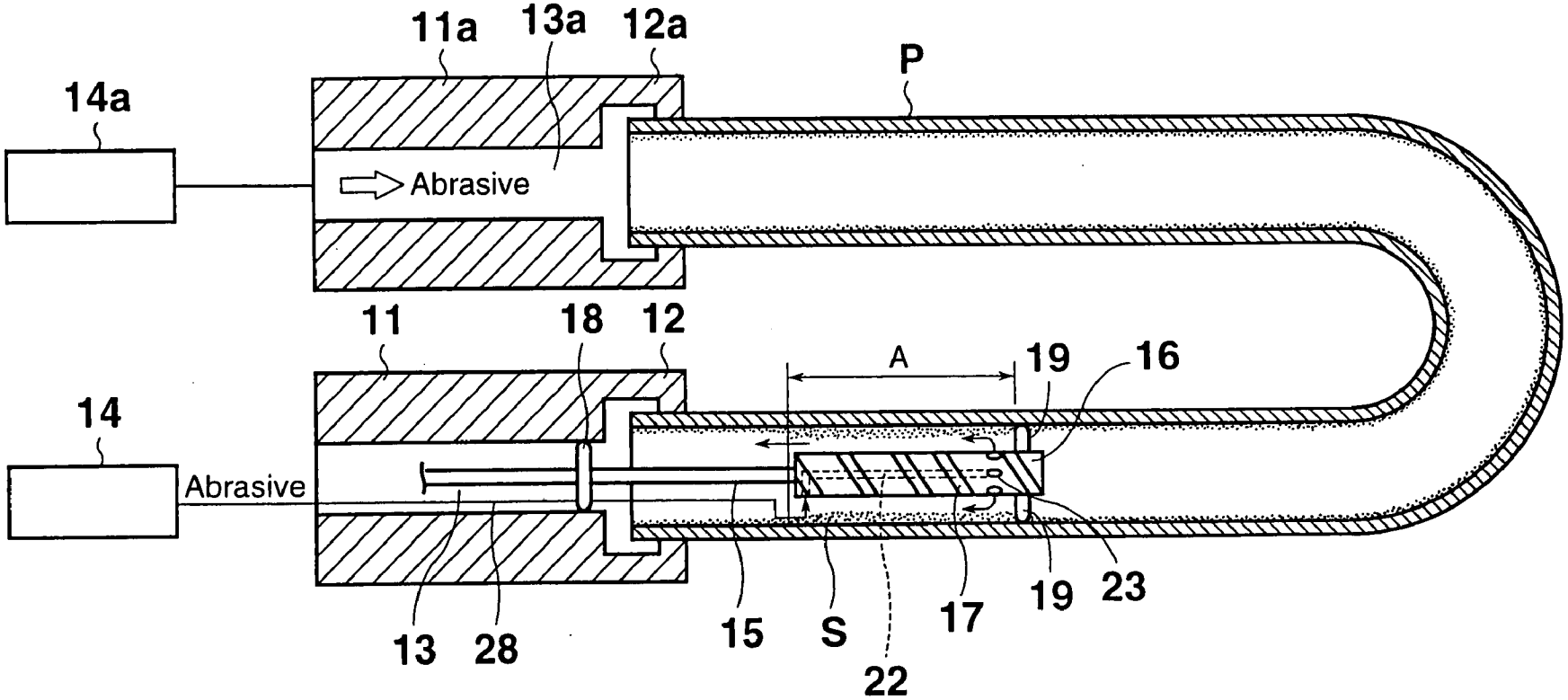
FIG. 11 is a view illustrating another connection example of the blast device and the blast path of the abrasion assisting member.

The blast device 14 is connected to the blast path 22 of the abrasion assisting member 16 by interposing the blast path 24 provided in the support arm 15 in the above-described third embodiment therebetween. However, the blast path 24 may not be provided in the support arm 15. Instead of this, furthermore, the blast path 22 of the abrasion assisting member 16 and the blast device 14 may be directly connected to each other by connecting means capable of absorbing a distance change between the abrasion assisting member 16 and the blast device 14, for example, the flexible hose 28 or a telescopic pipe as illustrated in FIG. 11.

Moreover, though the support arm 15 is supported in the blast path 13 of the holder 11 to be freely movable in the axial direction, it is not necessary that the support arm 15 be freely movable when the scale-abraded area A is fixedly determined, then a support arm 15 of which length is preset in accordance with the scale-abraded area A can be used when the scale-abraded area A is fixedly determined.

Furthermore, though not illustrated, a support arm, which is set freely movable in the axial direction and has a tip end that is freely insertable into/withdrawable from the inside of the pipe through the other opening end of the pipe, can be provided in the holder 11*a* similarly to that in FIG. 1, and an abrasion assisting member can also be attached onto the tip end of this support arm similarly to that in FIG. 1. In the foreign object removing apparatus thus constituted, foreign objects attached onto separate spots on the inner surface of the pipe can be abraded and removed simultaneously from the both ends of the pipe, that is, the one end and the other end of the pipe, respectively.

In any case, it is recommended that portions other than the pipe P, which are brought into contact with the abrasive, such as the abrasion assisting member 16, the blast path 22 in the inside thereof, the support arm 15, the blast path 24 in the inside thereof, the valve 27, and the hose 28, are constituted of materials that is as difficult as possible to be abraded by the abrasive.

The following are derived from the first to third embodiments described above.

(i) The foreign object removing apparatus, which comprises the abrasion assisting member 16 with the diameter smaller than the inner diameter of the pipe P, the member 16 being inserted into the pipe P; the holder mechanism (11 and 15) attachable to/detachable from the end of the pipe P for holding the abrasion assisting member 16; and the blast device 14 or 14*a* for sending the abrasive with pressure into the pipe P, increases the flow rate of the abrasive between the inner surface of the pipe P and the outer surface of the abrasion assisting member 16, and therefore can abrade and remove the foreign object or matter such as the scale S attached onto the inner surface of the pipe P easily for a short period of time by means of simple equipment. As described above, the abrasion assisting member 16 is one for increasing the flow rate of the abrasive, and can remove the large amount of scale S generated in the vicinity of the end of the pipe P by extremely simple work of inserting the abrasion assisting member 16 into the vicinity of the end of the pipe P, such as the area where the pipe plate and the outlet portion of the heat transfer pipe or the heat exchanger tube are connected to each other in the heat exchanger. The abrasive may be sent with pressure from any of the ends of the pipe P, which are the end from which the abrasion assisting member 16 is inserted and the end opposite thereto.

(ii) In addition to the foreign object removing apparatus of the foregoing (i), in the foreign object removing apparatus, in which, the holder 11 that is attachable to/detachable from the end of the pipe P and the support arm 15 supported in the holder 11 to be freely movable in the axial direction and having the tip end that is insertable into/withdrawable from the inside of the pipe P through the opening of the pipe P are provided as the holder mechanism, and the abrasion assisting member 16 is attached onto the tip end of the support arm 15, the foreign object such as the scale S attached onto the desired area A in the pipe P can be removed by operating the support arm 15.

(iii) In addition to the foreign object removing apparatus of the foregoing (ii), in the foreign object removing apparatus provided with the centering mechanism 18 for centering the abrasion assisting member 16 in the pipe P by interposing the support arm 15 therebetween in the holder 11, the space between the inner circumference of the pipe P and the outer circumference of the abrasion assisting member 16 is equalized in the circumferential direction, and therefore, the foreign object or matter S attached onto the inner surface of the pipe P can be removed appropriately.

(iv) In addition to the foreign object removing apparatus of the foregoing (ii), in the foreign object removing apparatus provided, on the tip end of the abrasion assisting member 16, with the clamping member 19 brought into contact with the inner circumferential surface of the pipe P to prevent vibrations, the space between the inner surface of the pipe P and the outer surface of the abrasion assisting member 16 is maintained at a predetermined interval, and therefore, the foreign object or matter attached onto the inner surface of the pipe P can be removed appropriately.

(v) In addition to the foreign object removing apparatus of the foregoing (ii), in the foreign object removing apparatus in which the spiral groove 17 is formed on the outer circumferential surface of the abrasion assisting member 16, the swirling flow of the abrasive is formed between the inner surface of the pipe P and the outer surface of the abrasion assisting member 16, and therefore, the foreign object or matter attached onto the inner surface of the pipe P can be removed securely.

(vi) In addition to the foreign object removing apparatus of the foregoing (i), in the foreign object removing apparatus provided, in the abrasion assisting member 16, with the tapered portion 20 with the outer diameter thinned downstream of the pipe, an amount of decompression/expansion by a pressure drop due to a pressure loss is compensated, and then the flow rate of the abrasive is equalized. Therefore, the foreign object or matter attached onto the inner surface of the pipe P can be removed evenly.

(vii) In addition to the foreign object removing apparatus of the foregoing (i), in the foreign object removing apparatus provided, in the abrasion assisting member 16, with the blast path 22 that is open from the downstream of the abrasive flow, passing through the inside to the outer circumference of the abrasion assisting member 16, and including the second blast device 14 for sending the abrasive with pressure into the blast path 22 in the reverse direction to the flowing direction of the abrasion in the pipe P, the injection of the abrasive from the outer circumferential openings 23 of the abrasion assisting member 16 and the flow of the abrasive in the pipe P synergize to increase the total amount of abrasive. In addition, due to the injection of the abrasive from the outer circumferential openings 23 of the abrasion assisting member 16, the flow rate or speed of the abrasive on the outer circumference of the abrasion assisting member 16 is further increased, and therefore, the foreign object or matter attached onto the inner surface of the pipe P can be removed more effectively. In this case, the second blast device 14 can also be commonly used as the blast device 14*a* for sending the abrasive with pressure into the pipe P. In the case of such common use, for example, the output of the one blast device 14 is branched into two, the appropriate valve 27 is provided in at least one branched path, and then the adjustment of the valve 27 makes it possible to adjust the amounts of abrasive and the rates at which the abrasive is sent with pressure between the branched paths.

(viii) In addition to the foreign object removing apparatus of the foregoing (vii), in the foreign object removing apparatus in which the blast device 14*a* sends the abrasive with pressure from the other end of the pipe P into the pipe P, and the second blast device 14 sends the abrasive with pressure from the one end of the pipe P into the blast path 22 of the abrasion assisting member 16, the abrasive can be easily sent with pressure into the blast path 22 of the abrasion assisting member 16 in the reverse direction to the flowing direction of the abrasive in the pipe P.

(ix) In addition to the foreign object removing apparatus in the foregoing (vii), in the foreign object removing apparatus which comprises the holder 11 that is attachable to/detachable from the end of the pipe P; the support arm 15 that is supported to be freely movable in the axial direction of the holder 11 and has the tip end that is insertable into/withdrawable from the inside of the pipe P through the opening of the pipe P; and the connecting device 28 for connecting the blast path 22 of the abrasion assisting member 16 to the blast device 14 and capable of absorbing the distance change between the abrasion assisting member 16 and the blast device 14, the foreign object or matter attached onto the desired area A in the pipe P can be removed by operating the support arm 15. As the connecting device 28, a flexible hose and a telescopic pipe can be used.

(x) In addition to the foreign object removing apparatus of the foregoing (i), in the foreign object removing apparatus provided with the spiral groove 17 on the abrasion assisting member 16, the swirling flow of the abrasive is generated between the inner surface of the pipe P and the outer surface of the abrasion assisting member 16, and therefore, the centrifugal force of the abrasive is increased to improve the abrasion effect, and the abraded surface, that is, the inner surface of the pipe P can be abraded smoothly.

(xi) Moreover, the foreign object removing method for removing the foreign object attached onto the inner surface of the pipe P, in which the abrasion assisting member 16 with the diameter smaller than the inner diameter of the pipe P is inserted into the pipe P, the abrasive is sent with pressure into the pipe P, and the flow rate of the abrasive is increased in the space between the inner surface of the pipe P and the outer surface of the abrasion assisting member 16, can remove the foreign object such as the scale S attached onto the inner surface of the pipe P easily for a short period of time in a simple manner. The large amount of scale S generated in the vicinity of the end of the pipe P can be removed by extremely simple work of inserting the abrasion assisting member 16 into the vicinity of the end of the pipe P such as the area where the pipe plate and the outlet portion of the heat transfer pipe are connected to each other in the heat exchanger.

(xii) In addition to the foreign object removing method in the foregoing (xi), in the foreign object removing method, in which the abrasion assisting member 16 is inserted into the pipe P by interposing the support arm 15 therebetween, and the abrasion assisting member 16 is centered and held at the position facing to the foreign object or matter, the space between the inner circumference of the pipe P and the outer circumference of the abrasion assisting member 16 is equalized in the circumferential direction, thus making it possible to remove the foreign object or matter attached onto the inner surface of the pipe P appropriately.

(xiii) In addition to the foreign object removing method of the foregoing (xi), in the foreign object removing method, in which the abrasive is sent with pressure into the inside of the abrasion assisting member 16 in the reverse direction to the flowing direction of the abrasive in the pipe P, and the abrasive is injected from the inside to outer circumference of the abrasion assisting member 16, the injection of the abrasive from the inside to outer circumference of the abrasion assisting member 16 and the flow of the abrasive in the pipe P synergize to increase the total amount of abrasive. In addition, the flow rate or speed of the abrasive on the outer circumference of the abrasion assisting member 16 is further enhanced, due to the injection of the abrasive from the inside to the outer circumference of the abrasion assisting member 16. Thus, it is made possible to remove the foreign object or matter attached onto the inner surface of the pipe P more effectively.

(xiv) In addition to the foreign object removing method of the foregoing (xi), in the foreign object removing method, in which the flow rate of the abrasive is made constant by the tapered portion 20 formed on the abrasion assisting member 16, in which the outer diameter is thinned downstream of the pipe, the foreign object or matter attached onto the inner surface of the pipe P can be removed evenly.

(xv) In addition to the foreign object removing method of the foregoing (xi), in the foreign object removing method, in which the centrifugal force of the abrasive is increased by the spiral groove 17 formed on the abrasion assisting member 16, the swirling flow of the abrasive is generated between the inner surface of the pipe P and the outer surface of the abrasion assisting member 16, and the centrifugal force of the abrasive is increased. Therefore, the abrasion effect is enhanced, and the abraded surface, that is, the inner surface of the pipe P can be abraded smoothly.

INDUSTRIAL APPLICABILITY

As described above, the apparatus and method for removing foreign object of the present invention are the ones, in which the abrasion assisting member is inserted into the pipe to increase the flow rate of the abrasive, thus making it possible to remove the foreign object or matter such as the scale attached onto the inner surface of the pipe easily for a short period of time. For example, the apparatus and the method are useful when being applied to the removal of the scale generated in a large amount in the vicinity of the end of the pipe.

What is claimed is:

1. An apparatus for removing a foreign object, comprising: an abrasion assisting member with a diameter smaller than an inner diameter of a pipe, the abrasion assisting member being inserted into the pipe; a holder mechanism for holding the abrasion assisting member, the holder mechanism being attachable to/detachable from an end of the pipe; and blasting means for sending abrasive with pressure into the pipe to remove the foreign object attached onto an inner surface of the pipe, wherein a spiral groove is provided on the abrasion assisting member.

2. The apparatus for removing a foreign object according to claim 1, wherein a holder that is attachable to/detachable from the end of the pipe and a support arm supported in the holder to be freely movable in an axial direction thereof and having a tip end freely insertable into/withdrawable from the inside of the pipe through an opening of the pipe are included as the holder mechanism, and the abrasion assisting member is attached onto the tip end of the support arm.

3. The apparatus for removing a foreign object according to claim 2, wherein a centering mechanism for centering the abrasion assisting member inside the pipe by interposing the support arm therebetween is provided in the holder.

4. An apparatus for removing a foreign object comprising: an abrasion assisting member with a diameter smaller than an inner diameter of a pipe, the abrasion assisting member being inserted into the pipe; a holder mechanism for holding the abrasion assisting member, the holder mechanism being attachable to/detachable from an end of the pipe; and blasting means for sending abrasive with pressure into the pipe to remove the foreign object attached onto an inner surface of the pipe, wherein a holder that is attachable to/detachable from the end of the pipe and a support arm supported in the holder to be freely movable in an axial direction thereof and having a tip end freely insertable into/withdrawable from the inside of the pipe through an opening of the pipe are included as the holder mechanism, and the abrasion assisting member is attached onto the tip end of the support arm, and wherein a clamping member brought into contact with an inner circumferential surface of the pipe to prevent vibrations is provided on the tip end of the abrasion assisting member.

5. The apparatus for removing a foreign object according to claim 2, wherein the spiral groove is formed on an outer circumferential surface of the abrasion assisting member.

6. The apparatus for removing a foreign object according to claim 1, wherein a tapered portion with an outer diameter thinned downstream of the pipe is provided in the abrasion assisting member.

7. An apparatus for removing a foreign object comprising: an abrasion assisting member with a diameter smaller than an inner diameter of a pipe, the abrasion assisting member being inserted into the pipe; a holder mechanism for holding the abrasion assisting member, the holder mechanism being attachable to/detachable from an end of the pipe; and blasting means for sending abrasive with pressure into the pipe to remove the foreign object attached onto an inner surface of the pipe, wherein a blast path that is open from a downstream of an abrasive flow, passing through an inside of the abrasion assisting member to an outer circumference thereof is provided in the abrasion assisting member, and second blasting means for sending the abrasive with pressure into the blast path in a reverse direction to a flowing direction of the abrasive in the pipe is provided.

8. The apparatus for removing a foreign object according to claim 7, wherein the blasting means sends the abrasive with pressure into the pipe from one end of the pipe, and the second blasting means sends the abrasive with pressure into the blast path from the other end of the pipe.

9. The apparatus for removing a foreign object according to claim 7, wherein a holder that is attachable to/detachable from the end of the pipe, a support arm supported in the holder to be freely movable in an axial direction thereof and having a tip end freely insertable into/withdrawable from the pipe through an opening of the pipe, and connecting means for connecting the blast path of the abrasion assisting member to the second blasting means, the connecting means being capable of absorbing a distance change between the abrasion assisting member and the second blasting means, are provided.

10. A method for removing a foreign object, comprising the steps of: inserting, into a pipe, an abrasion assisting member with a diameter smaller than an inner diameter of the pipe; sending abrasive with pressure into the pipe; increasing a flow rate of the abrasive in a space between an inner surface of the pipe and the abrasion assisting member; and removing a foreign object attached onto the inner surface of the pipe, wherein centrifugal force of the abrasive is increased by a spiral groove formed on the abrasion assisting member.

11. The method for removing a foreign object according to claim 10, wherein the abrasion assisting member is inserted into the pipe by interposing a support arm therebetween, and the abrasion assisting member is centered and held at a position facing to the foreign object.

12. A method for removing a foreign object, comprising the steps of: inserting, into a pipe, an abrasion assisting member with a diameter smaller than an inner diameter of the pipe; sending abrasive with pressure into the pipe; increasing a flow rate of the abrasive in a space between an inner surface of the pipe and the abrasion assisting member; and removing a foreign object attached onto the inner surface of the pipe, wherein the abrasive is sent with pressure into an inside of the abrasion assisting member in a reverse direction to a flowing direction of the abrasive in the pipe, and the abrasive is injected from an inside of the abrasion assisting member to an outer circumference thereof.

13. The method for removing a foreign object according to claim 10, wherein the flow rate of the abrasive is made constant by a tapered portion with an outer diameter thinned downstream of the pipe, the tapered portion being formed on the abrasion assisting member.

* * * * *